United States Patent [19]

Delfino et al.

[11] Patent Number: 4,777,125

[45] Date of Patent: Oct. 11, 1988

[54] LIGHT-SENSITIVE SILVER HALIDE EMULSION AND RADIOGRAPHIC ELEMENTS WITH AN IMPROVED IMAGE QUALITY AND REDUCED RESIDUAL STAIN

[75] Inventors: Gerolamo Delfino; Milena Debenedetti, both of Savona, Italy

[73] Assignee: Minnesota Mining and Manufacturing Company, St. Paul, Minn.

[21] Appl. No.: 45,620

[22] Filed: May 1, 1987

[30] Foreign Application Priority Data

May 8, 1986 [IT] Italy ..... 20369 A/86

[51] Int. Cl.[4] ..... G03C 1/08; G03C 7/26; G03C 1/02; G03C 7/38

[52] U.S. Cl. ..... 430/567; 430/523; 430/542; 430/569; 430/572; 430/576; 430/577; 430/615

[58] Field of Search ..... 430/567, 576, 569, 572, 430/577, 615, 523, 542

[56] References Cited

U.S. PATENT DOCUMENTS

| | | | |
|---|---|---|---|
| 3,864,134 | 2/1975 | Ueda et al. | 96/124 |
| 3,865,598 | 2/1975 | Shiba et al. | 96/125 |
| 4,097,284 | 1/1978 | Tani | 430/576 X |
| 4,138,266 | 2/1979 | Hinata et al. | 430/576 X |
| 4,199,366 | 4/1980 | Hinata et al. | 430/576 X |
| 4,425,425 | 1/1984 | Abbott et al. | 430/502 |
| 4,520,098 | 5/1985 | Dickerson | 430/495 |
| 4,551,424 | 11/1985 | Ikeda et al. | 430/576 X |
| 4,582,786 | 4/1986 | Ikeda et al. | 430/576 X |

*Primary Examiner*—Mukund J. Shah

*Attorney, Agent, or Firm*—Donald M. Sell; Mark A. Litman

[57] ABSTRACT

A silver halide emulsion for use in a radiographic element,—comprising at least one silver halide emulsion layer coated on one side or on both sides of a transparent support—, characterized by the fact that it contains silver halide cubic grains having J-band spectral sensitizing dyes adsorbed on the surface thereof in a quantity substantially higher than that amount which substantially optimally sensitizes said grains, exhibits a reduced residual stain and an improved image quality.

27 Claims, No Drawings

LIGHT-SENSITIVE SILVER HALIDE EMULSION AND RADIOGRAPHIC ELEMENTS WITH AN IMPROVED IMAGE QUALITY AND REDUCED RESIDUAL STAIN

FIELD OF THE INVENTION

The present invention relates to silver halide radiographic elements. The invention relates more particularly to radiographic elements containing silver halide emulsion layers coated on at least one side of a transparent support.

BACKGROUND OF THE INVENTION

Silver halide photographic elements for use in medical radiography commonly include silver halide emulsion layers coated on one side (single emulsion layer coated) or on both sides (double emulsion layer coated) of the support in order to minimize the X-ray dosage received by a patient.

Since silver halide emulsions are relatively inefficient X-ray absorbers, it is common use to associate the radiographic element with intensifying screens which absorb X-rays and emit near UV or visible light to which the radiographic element is sensitive or has been sensitized with spectral sensitizing dyes absorbed on the silver halide crystals.

The quality of image obtained upon exposure and development of said radiographic elements results negatively affected by light scattering and crossover exposure.

Light scattering occurs both in single and double emulsion layer coated radiographic materials when light emitted by one screen is diffused (scattered) by silver halide grains causing a reduction in image sharpness.

Crossover exposure, which also causes a reduction in image sharpness, occurs in double emulsion layer coated radiographic materials when light emitted by one screen passes through the adjacent emulsion layer and the support and, the light having been spread by the support, imagewise exposes the emulsion layer on the opposite side of the support.

Various means have been suggested to reduce light scattering and cross-over exposure, such as, for example, the use of dyes or other materials to alter the composition of silver halide layers, the introduction of optically separating barriers, e.g. undercoats which can be positioned between the silver halide layers or between the silver halide layer and the support, and the like. Such means, however, result in a significant reduction in the sensitivity of the radiographic element to the light emitted by the screens.

Recently high aspect ratio tabular emulsions have been described for use in double layer coated radiographic elements, see e.g. U.S. Pat. No. 4,425,425. Spectral sensitizing dyes are adsorbed on the surface of the tabular silver halide grains in an amount sufficient to substantially optimally sensitize said tabular silver halide grains, preferably spectral sensitizing dyes of the J-band sensitizing type. As is well known in the art (e.g., F. M. Hamer: Cyanine Dyes and Related Compounds, p. 710 (1964), Interscience Publisher), the sensitization maximum of a sensitizing dye in a silver halide emulsion (M-band sensitization maximum due to molecular absorption) lies near the absorption maximum of the free dye in an aqueous solution. Certain sensitizing dyes have a sharp sensitization band at a wavelength slightly longer (about 20 to 50 μm) than the wavelength corresponding to the M-band sensitization maximum. This is known as J-band sensitization and the dyes are known as J-band spectral sensitizing dyes. It is also known that the J-band sensitization can be strengthened by adding water soluble iodides or bromides to the silver halide emulsions, such as described for example in The Photographic Journal, 90 B, 142 (1950); Zeitschrift für wissenschaftliche Photographie, 53, 209, (1959); Photographic Science and Engineering, 13, 13–17, (1969) and in U.S. Pat. Nos. 3,865,598 and 3,864,134.

The sensitizing dye, adsorbed on the surface of tabular silver halide grains, acts also as a filter dye since it captures some of the radiation causing the cross-over exposure. Therefore, high aspect ratio tabular silver halide grains provide radiographic elements exhibiting reduced cross-over of exposure and therefore less reduction of sharpness attributable to cross-over.

A disadvantage that has been encountered with the use of high aspect ratio tabular silver halide grains is the stain due to the yellow-brown color of the developed silver image and to the residual spectral sensitizing dye which remains in the photographic element at the end of the processing, as described for example in U.S. Pat. No. 4,520,098 and in Japanese patent application S.N. J60/128,432. Such residual stain gives the image an undesired tone and disturbs the proper interpretation of the X-ray image. Attempts to reduce said stain by reducing the amount of the sensitizing dye adsorbed on the surface of the tabular silver halide grains causes a reduction in sensitivity.

Accordingly, there is still the need to provide low light-scattering and cross-over silver halide emulsion radiographic elements having reduced stain from the presence of spectral sensitizing dyes.

SUMMARY OF THE INVENTION

The present invention refers to a photographic emulsion for use in a radiographic element comprising at least one silver halide emulsion layer coated on at least one side of a transparent support. Said photographic emulsion contains cubic silver halide grains having J-band spectral sensitizing dyes adsorbed on their surface in an amount substantially higher than that necessary to substantially optimally sensitize said grains. Preferably said J-band sensitizing dyes are added to the cubic silver halide grains in reactive association with water soluble iodide and/or water soluble bromide, more preferably in reactive association with a supersensitizer. The radiographic elements of this invention exhibits reduced residual dye stain and reduced light scattering and cross-over exposure at a comparable photographic speed as compared to radiographic elements comprising high aspect ratio tabular grain silver halide emulsions.

DETAILED DESCRIPTION OF THE INVENTION

In one aspect the present invention relates to a light-sensitive silver halide emulsion comprising low aspect ratio cubic silver halide grains and J-band spectral sensitizing dyes adsorbed on the surface of said cubic silver halide grains in an amount substantially higher than that amount which substantially optimally sensitizes said cubic grains.

In another aspect the present invention relates to a photographic element for forming a radiographic inage, comprising at least one silver halide emulsion layer coated on at least one side of a transparent support, said emulsion comprising low aspect ratio cubic silver halide grains having J-band spectral sensitizing dyes adsorbed on the surface of said silver halide grains in an amount substantially higher than that amout which substantially optimally sensitizes said grains.

In a further aspect the present invention relates to a photographic element for use in forming a radiographic image, comprising at least one silver halide emulsion layer coated on both sides of a transparent support, each layer containing low aspect ratio cubic silver halide grains having J-band spectral sensitizing dyes adsorbed on the surface of said silver halide grains in an amount substantially higher than that amount which substantially optimally sensitizes said grains.

Said substantially higher amount means a quantity which is required to obtain, in a double side coated radiographic element, a reduction of the cross-over exposure of at least 5% from the cross-over effect exhibited without such additional amount of dye. In quantitative terms, it generally means about 1.5 times the quantity minimally necessary to optimally sensitize the emulsion.

Silver halide emulsions of the present invention comprise a dispersing medium and low aspect ratio cubic silver halide grains. The term "cubic grains" according to the present invention is intended to include substantially cubic grains, that is silver halide grains which are regular cubic grains bounded by crystallographic faces (100), or which may have rounded edges and/or vertices or small faces (111), or may even be nearly spherical when prepared in the presence of soluble iodides or strong ripening agents, such as ammonia. The aspect ratio, that is the ratio of diameter to thickness, of said cubic silver halide grains is lower than 8:1, preferably lower than 5:1 and most preferably is less than 3:1 and about 1:1. The silver halide grains may be of any required composition for forming a negative silver image, such as silver chloride, silver bromide, silver iodide, silver chloro-bromide, silver bromo-iodide and the like. Particularly good results are obtained with silver bromo-iodide grains, preferably silver bromo-iodide grains containing about 0.1 to 15% moles of iodide ions, more preferably about 0.5 to 10% moles of iodide ions and still preferably silver bromo-iodide grains having average grain sizes in the range from 0.1 to 3$\mu$, more preferably from 0.2 to 1.5$\mu$.

The cubic grain silver halide emulsions of the present invention can be prepared by conventional methods, such as described in Research Disclosure, Vol. 176, December 1978, Item 17643. According to one preferred procedure, these emulsions can be prepared by a double jet precipitation process. Into a conventional reaction vessel for silver halide precipitation, equipped with an efficient stirring mechanism, is introduced a dispersing medium. Typically the dispersion medium initially introduced into the reaction vessel is about 10 to 50% by weight, preferably is about 20% by weight, based on the total weight of the dispersion medium present in the silver halide emulsion at the end of grain precipitation, the remaining portion of the dispersion medium being added after having removed the water soluble salts at the completion of silver halide precipitation. During precipitation, silver and halide salts are added to the reaction vessel by techniques well known in the precipitation of silver halide grains. Typically, an aqueous solution of a soluble silver salt, such as silver nitrate, is introduced into the reaction vessel concurrently with the introduction of the halide salts. A high pH, preferably a pH of about 9 to 11, in the reaction vessel favorites the formation of the cubic grains. Said pH may be maintained during all the precipitation process or during part of said process. Particularly good results are obtained by precipitating about 10 to 30% by weight of the silver halide grains at a low pH, preferably from about 5 to 6, and the remaining silver halide grains at said high pH.

The dispersing medium for the silver halide grains can be chosen among those conventionally employed in the silver halide emulsions. Preferred dispersion media include hydrophilic colloids, such as proteins, protein derivatives, cellulose derivatives (e.g. cellulose esters), gelatin (e.g. acid or alkali treated gelatin), gelatin derivatives (e.g. acetylated gelatin, phthalated gelatin and the like), polysaccarides (e.g. dextran), gum arabic, casein and the like. It is also common to employ said hydrophylic colloids in combination with synthetic polymeric binders and peptizers such as acrylamide and methacrylamide polymers, polymers of alkyl and sulfoalkyl acrylates and methacrylates, polyvinyl alcohol and its derivatives, polyvinyl lactams, polyamides, polyamines, polyvinyl acetates, and the like.

The cubic grain silver halide emulsions may be chemically sensitized by any procedure known in the photographic art. The emulsion may be digested with active gelatins or with sulfur-containing compounds such as sodium thiosulfate, allylthiocyanate, allylyhiourea, and the like. The silver halide emulsions may be sensitized by means of reductors, e.g. tin compounds as described in GB No. 789,823, polyamines and small amounts of noble metal compounds, such as gold, platinum, iridium, ruthenium and rhodium.

The cubic grain silver halide emulsions of the present invention are spectrally sensitized. The silver halide grains have adsorbed on their surface spectral sensitizing dyes that exhibit absorption maxima in the blue and/or green and/or red portions of the visible spectrum. Spectral sensitizing dyes according to this invention produce J aggregates if adsorbed on the surface of the silver halide grains and a sharp sensitizing band (J-band) with a bathocromic shifting with respect to the absorption maximum of the free dye in aqueous solution. Spectral sensitizing dyes producing J aggregates are well known in the art, as illustrated by F. M. Hamer, Cyanine Dyes and Related Compounds, John Wiley and Sons, 1964, Chapter XVII and by T. H. James, The Theory of the Photographic Process, 4th edition, Macmillan, 1977, Chapter 8.

In a preferred form, J-band exhibiting dyes are carbocyanine dyes. Such dyes comprise two basic heterocyclic nuclei joined by a linkage of three methine groups. The heterocyclic nuclei preferably include fused benzene rings to enhance J aggregation.

The heterocyclic nuclei are preferably quinolinium, benzoxazolium, benzothiazolium, benzoselenazolium, benzimidazolium, naphthoxazolium, naphthothiazolium and naphthoselenazolium quaternary salts.

J-band type dyes preferably used in the present invention have the following general formula:

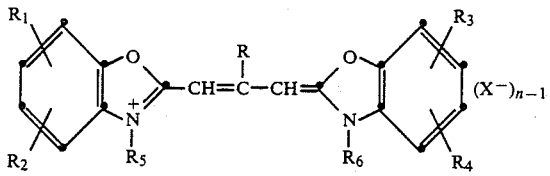

wherein R represents a hydrogen atom or an alkyl group (e.g. methyl, ethyl, etc.); R1, R2, R3 and R4 each represents a hydrogen atom, a halogen atom (e.g. chlorine, bromine, iodine and fluorine), a hydroxy group, an alkoxy group (e.g. methoxy, ethoxy, etc.), an amino group (e.g. amino, methylamino, dimethylamino, etc.), an acylamido group (e.g. acetamido, propionamido, etc.), an acyloxy group (e.g. acetoxy group, etc.), an alkoxycarbonyl group (e.g. methoxycarbonyl, ethoxycarbonyl, butoxycarbonyl, etc.), an alkyl group (e.g. methyl, ethyl, isopropyl, etc.), an alkoxycarbonylamino group (e.g. ethoxycarbonylamino, etc.), or an aryl group (e.g. phenyl, tolyl, etc.), or R1 and R2, and respectively R3 and R4 can be the atoms necessary to form a benzene nucleus (so that the heterocyclic nucleus results to be, for example, an $\alpha$-naphthoxazole nucleus, a $\beta$-naphthoxazole or a $\beta,\beta'$-naphthoxazole); R5 and R6 each represents an alkyl group (e.g. methyl, propyl, butyl, etc.), a hydroxyalkyl group (e.g. 2-hydroxyethyl, 3-hydroxypropyl, 4-hydroxybutyl, etc.), an acetoxyalkyl group (e.g. 2-acetoxyethyl, 4-acetoxybutyl, etc.), an alkoxyalkyl group (e.g. 2-methoxyethyl, 3-methoxypropyl, etc.), an alkyl group containing a carboxyl group (e.g. carboxymethyl, 2-carboxyethyl, 4-carboxybutyl, 2-(2-caboxyethoxy)-ethyl, etc.), an alkyl group associated with a sulfo group (e.g. 2-sulfoethyl, 3-sulfopropyl, 4-sulfobutyl, 2-hydroxy-3-sulfopropyl, 2-(3-sulfopropoxy)propyl, p-sulfobenzyl, p-sulfophenethyl, etc.), a benzyl group, a phenethyl group, a vinylmethyl group, and the like; $X^-$ represents an acid anion (e.g. a chloride, bromide, iodide, thiocyanate, methylsulfate, ethylsulfate, perchlorate, p-toluensulfonate ion, etc.); n represents 1 or 2.

The alkyl groups included in said substituents R, $R_1$, $R_2$, $R_3$, $R_4$, $R_5$ and $R_6$ and, more particularly, the alkyl portions of said alkoxy, alkoxycarbonyl, alkoxycarbonylamino, hydroxyalkyl, acetoxyalkyl groups and of the alkyl groups associated with a carboxy or sulfo group each preferably contain from 1 to 12, more preferably from 1 to 4 carbon atoms, the total number of carbon atoms included in said groups preferably being no more than 20.

The aryl groups included in said substituents $R_1$, $R_2$, $R_3$ and $R_4$ each preferably contain from 6 to 18, more preferably from 6 to 10 carbon atoms, the total number of carbon atoms included in said groups arriving up to 20 carbon atoms.

The following are specific examples of J-band sensitizing dyes belonging to those represented by the general formula above:

| Col. | 1* | 2** | 3 | 4 | 5 | 6 |
|---|---|---|---|---|---|---|
| R | $C_2H_5$ | $C_2H_5$ | $CH_3$ | $C_2H_5$ | $C_2H_5$ | $C_2H_5$ |
| $R_1$ | H | H | H | 6-$CH_3$ | H | H |
| $R_2$ | 5-Cl | 5-$OCH_3$ | 5-$OCH_3$ | 5-Cl | 5-Cl | 5-Cl |
| $R_3$ | H | H | H | 6'-$CH_3$ | H | H |
| $R_4$ | 5'-Cl | 5'-$OCH_3$ | 5'-$CH_3$ | 5'-Cl | 5'-Cl | 5'Cl |
| $R_5$ | $(CH_2)_3SO_3$— | $(CH_2)_3SO_3$— | $C_2H_5$ | $(CH_2)_4SO_3$— | $(CH_2)CH(CH_3)SO_3$— | $C_2H_5$ |
| $R_6$ | $(CH_2)_3SO_3H$ | $(CH_2)SO_3Na$ | $(CH_2)_3SO_3$— | $(CH_2)_4SO_3H$ | $(CH_2)CH(CH_3)SO_3H$ | $C_2H_5$ |
| X | — | — | — | — | — | J |
| n | 1 | 1 | 1 | 1 | 1 | 2 |

*Triethylamine salt
**Sodium salt

According to the present invention, said spectral sensitizing dyes are employed in an amount substantially higher than that necessary to substantially optimally sensitize the cubic silver halide grains, preferably in an amount from two to eight times said optimum amount, more preferably in an amount from three to five times said optimum amount. Preferred amounts of spectral sensitizers in the photographic emulsion are in the range from 0.5 to 2 millimoles per mole of silver halide. More preferred quantities range from 0.6 to 1.2 millimoles per mole of silver halide.

It is known in the photographic art that photographic speed obtainable from the silver halide grains increases with the increasing concentration of the sensitizing dye untill maximum speed is obtained with an optimum dye concentration, after that, further increases in dye concentration cause a decrease in the obtainable speed. The optimum amount of dye employed can vary dependently upon the specific dye, as well as upon the size and aspect of the grains. Surprisingly, the amount of dye adsorbed on the surface of the low aspect ratio cubic grain silver halide emulsions can be increased beyond the optimum dye concentration to obtain the full advantages of this invention, i.e. a reduced light scattering and cross-over exposure and a reduced residual stain, without any significant loss in speed. Said cross-over reduction is preferably at least 10%, more preferably at least 20% and most preferably at least 30% lower than the cross-over which can be obtained with the optimum dye concentration.

With the cubic silver halide grains of the present invention the sharpness to undesired tone ratio can be optimized, at a comparable photographic sensitivity, with dye sensitizer amounts lower than needed with tabular grains.

The J-band sensitization dyes are preferably added to the low aspect ratio cubic grain silver halide emulsions in the presence of a water soluble iodide or bromide salt. The J-band sensitization is increased by the presence of said salts, increasing the strong coloration of the element before processing and consequently reducing the cross-over of exposing radiations by adding a smaller amount of dye. The residual stain after processing of the radiographic element also is lower. Said salts are more advantageously added to the silver halide emulsion before dye digestion, that is the pause following dye addition; said pause is preferably made at a temperature of 40° to 60° C. for a time of about 50 to 150 minutes.

Typical water soluble salts include alkali metal, alkali earth metal and ammonium iodide and bromide such as ammonium, potassium, lithium, sodium, cadmium and strontium iodides and bromides. The amount of said water soluble iodide and bromide salts is advantageously lower than 100 mg per mole of silver, and preferably ranges from about 40 to about 70 mg per mole of silver.

The spectral sensitizing dyes can be used in combination among them or with other addenda, such stabilizers, antifoggants, development modifiers, coating agents, brighteners and antistatic agents, which combination results in a supersensitization (that is, into a spectral sensitization higher than that which could be obtained with any dye or addendum used alone or would result from the additive effect of the dyes and addenda). Mechanisms and compounds responsible for supersensitization are described for example in Photographic Science and Engineering, 18, 418–430, (1974). In particular advantageous results are obtained according to this invention by combining the spectral sensitizing dyes with a supersensitizing amount of a polymeric compound having amino-allilydene-malononitrile moieties, as described in U.S. Pat. No. 4,307,183, such as copolymers of a vinyl addition monomers and 3-diallyl-amino-allylidene-malononitrile monomer.

In addition to the features specifically described above, the photographic elements of this invention, in the silver halide emulsion layers or in other layers, can include additional addenda of conventional nature, such as stabilizers, antifoggants, brighteners, absorbing materials, hardeners, coating aids, plasticizers, lubricants, matting agents, antikinking agents, antistatic agents, and the like, as described in Research Disclosure, Item 17643, December 1978 and in Research Disclosure, Item 18431, August 1979.

Preferred photographic elements are of the type described in BE Patent No. 757,815 and in U.S. Pat. No. 3,705,858, i.e. elements wherein at least one low aspect ratio cubic grain silver halide emulsion layer is coated on both surfaces of a transparent support, the total silver coverage per surface unit for both layers being lower than about 6 g/m$^2$, preferably than 5 g/m$^2$. Such supports are preferably polyester film supports, such as polyethylene terephthalate films. Generally said supports for use in medical radiography are blue tinted. Preferred dyes are anthraquinone dyes, such as those described in U.S. Pat. Nos. 3,488,195; 3,849,139; 3,918,976; 3,933,502; 3,948,664 and in UK Pat. Nos. 1,250,983 and 1,372,668.

The spectral sensitizing dyes according to the present invention, in their adsorbed state, exhibit an absorption peak in a region of the spectrum which corresponds to the wavelength of the electromagnetic radiation to which the element is image-wise exposed. Said radiation is emitted by the phosphors of the intensifying screens, between which the element is interposed. A separate intensifying screen exposes each of the two silver halide emulsion layers coated on the opposite sides of the support. The intensifying screens emit light in the ultraviolet, blue, green or red portions of the spectrum, depending upon the specific phosphors incorporated therein. It is common for the intensifying screens to emit light in the green (500 to 600 nm) region of the spectrum. Therefore, the preferred spectral sensitizing dyes for use in the practice of the present invention are those exhibiting an absorption peak in the green portion of the spectrum.

The intensifying screens can be a part of the radiographic element, but usually they are separate elements which are reused to provide further exposures of radiographic elements. The intensifying screens are well known in the radiographic art. Conventional intensifying screens and their components are disclosed for examlple in Research Disclosure, Item 18431, cited above.

The exposed radiographic elements can be processed by any of the conventional processing techniques. Such processing techniques are illustrated for example in Research Disclosure, Item 17643, cited above. Roller transport processing is particularly preferred, as illustrated in U.S. Pat. Nos. 3,025,779; 3,515,556; 3,545,971 and 3,647,459 and in UK Pat. No. 1,269,268. Hardening development can be undertaken, as illustrated in U.S. Pat. No. 3,232,761.

The invention is now better illustrated by making reference to the following illustrative example.

EXAMPLE 1

A cubic grain silver bromo-iodide gelatin emulsion (having 2.3% iodide moles) was prepared. Said emulsion comprised cubic grains having an average diameter of about 0.65 μm and an average aspect ratio of about 1:1. The emulsion was spectrally sensitized with 400 mg/mole of silver of the green sensitizing dye anhydrous 5,5'-dichloro-9-ethyl-3,3'-di-(3-sulfopropyl)-oxacarbocyanine hydroxide triethylammonium salt and 50 mg/mole of silver of potassium iodide. The emulsion, added with stabilizing and antifogging agents, surface active agents and gelatin hardeners, was coated on one side of a polyethylene terephthalate transparent film support. The emulsion was coated at a silver coverage of 4 g/m$^2$. The emulsion layer was overcoated with a gelatin layer at a gelatin coverage of 1.1 g/m$^2$. Samples of the obtained film were stored at 50° C. for 15 hours and exposed by means of a tunfsten lamp through a continuous tone wedge and a Kodak Wratten TM 99 filter.

Other samples were stored at 50° C. for 15 hours, put into contact with a 3M Trimax TM 8 intensifying screen and exposed through a laminated aluminium step wedge to X-rays of 300 ma and 80 kV for 0.06 seconds.

After exposure, the film samples were processed in a 3M Trimatic TM XP 507 roller transport processor. Processing consisted of 3M XAD/2 Developer for 24 seconds at 35° C., followed by fixing in 3M XAF/2 Fixer for 24 seconds, washing with tap water for 22 seconds at 35° C. and drying for 22 seconds at 35° C.

Table 1 reports the values of speed at green light and X-ray exposures and J band. Speed is expressed as relative log E (wherein E is Exposure in meter-candle-seconds). The measure of J banding was made referring to the spectrophotometric curve of the unexposed film in the region of 400 to 700 nm by measuring absorbance at 545 nm, which corresponds to the dye absorbance J band peak.

TABLE 1

| Emuls. | Dye mg/M | KI mg/M | Green light speed | X-ray speed | J-band |
|---|---|---|---|---|---|
| Cubic | 400 | 50 | 2.45 | 2.57 | 1.19 |

The image quality of the exposed and processed film resulted to be excellent.

EXAMPLE 2

A cubic grain silver bromo-iodide emulsion was prepared as described in Example 1. Various portions of the emulsion was spectrally sensitized with different amounts of the green sensitizing dye anhydrous 5,5'-dichloro-9-ethyl-3,3'-di-(3-sulfopropyl)-oxacarbocyanine hydroxide sodium salt. Different amounts of iodide in the form of potassium iodide were added to each portion of emulsion before adding the dye. Each portion of the emulsion was then added with 8.7 mg/mole of silver of a (acrylamide-allyl-amino-allylidene-malononitrile) copolymer containing about 9% w/w of amino-allylidene-malononitrile moieties. Each emulsion was then coated on both sides of identical poly-(ethyleneterephthalate) transparent film supports. The emulsions were each coated at 2.25 g/m$^2$ silver and 1,66 g/m$^2$ gelatin per side. Each emulsion layer was finally overcoated with a gelatin layer at a gelatin coverage of 1.1 g/m$^2$.

A control film was prepared employing a high aspect ratio silver bromo-iodide (having 1.5% iodide moles, prepared according to example 7 of UK Pat. No. 2,110,402, wherein about 63% of the total grain projected area was accounted for by tabular grains having an average diameter of about 1.15 μm, a thickness of 0.039 μm and an average aspect ratio of about 29:1. The tabular grain emulsion was spectrally sensitized with 750 mg/mole of silver of the dye above. After addition of the dye, the emulsion was then added with 216 mg/mole of silver of potassium iodide. The emulsion was coated on both sides of the support above at 1.65 g/m$^2$ of silver and 1,5 g/m$^2$ of gelatin per side. Each emulsion layer was finally overcoated with a gelatin layer applied at 1,1 g/m$^2$ of gelatin.

Samples of the films were stored at 50° C. for 15 hours. Each film was interposed between two green emitting 3M Trimax TM 8 intensifying screens, then exposed through a laminated aluminum step wedge to X-rays of 300 ma and 80 kV for 0,06 seconds. After the exposure, the film samples were processed in a 3M Trimatic TM XP 507 roller transport processor. Processing consisted of 3M XAD/2 Developer for 24 seconds at 35° C., followed by fixing in 3M XAF/2 Fixer for 24 seconds at 30° C., washing in tap water for 22 seconds at 35° C. and drying for 22 seconds at 35° C.

The sensitometric and image quality results are tabulated in the following table. Percent cross-over has been calculated by using the following equation:

$$\text{Percent Crossover} = \frac{1}{\text{antilog}\,(\Delta\log E)} \times 100$$

wherein log E is the difference in sensitivity between the two emulsion layers of the same film when exposed with a single screen.

Residual stain was rated subjectively on a numerical scale, in which:

1 is excellent
2 is very good
3 is good
4 is acceptable
5 is poor.

A measure of J banding was made as described in Example 1.

TABLE 2

| Emuls. | Dye mg/M | KI mg/M | X-ray Speed | J band Absorb. | Crossover % | Stain |
|---|---|---|---|---|---|---|
| Tabul. | 750 | 216 | 2.36 | 1.412 | 36.0 | 5 |
| Cubic | 166 | 0 | 2.34 | 1.176 | 45.2 | 1 |
| Cubic | 1066 | 60 | 2.28 | 1.508 | 32.3 | 4 |
| Cubic | 899 | 97 | 2.29 | 1.588 | 33.3 | 3 |
| Cubic | 633 | 60 | 2.28 | 1.557 | 33.0 | 2 |
| Cubic | 367 | 97 | 2.32 | 1.476 | 35.4 | 1 |
| Cubic | 633 | 0 | 2.32 | 1.388 | 36.1 | 2 |

The results, reported in Table 1, show that a radiographic element according to the present invention has, at a comparable X-ray speed and percent cross-over, a greatly reduced dye stain in comparison with the tabular grain emulsions. Also the tone of the image made of developed silver resulted almost neutral with the element of this invention, while resulted yellowish and unacceptable with the control element.

EXAMPLE 3

One film including an emulsion substantially identical to that of Example 2 with 367 mg/M of dye was made except that no malononitrile compound was included. The film was exposed, processed and evaluated as in Example 2. It was found to give the same results as in Example 2 with a speed lower of about 0.05 Log E.

We claim:

1. A light-sensitive silver halide emulsion comprising low aspect ratio cubic silver halide grains and J-band spectral sensitizing dyes adsorbed on the surface of said cubic silver halide grains in an amount substantially higher than that amount which substantially optimally sensitizes said cubic grains.

2. The light-sensitive silver halide emulsion according to claim 1 wherein the silver halide is a silver bromo-iodide having an average grain size in the range from 0.2 to 1.5μ.

3. The light-sensitive silver halide emulsion according to claim 1 wherein said J-band spectral sensitizing dye is a carbocyanine dye.

4. The light-sensitive silver halide emulsion according to claim 1 wherein said J-band spectral sensitizing dye is adsorbed on the surface of the cubic silver halide grains in an amount of two to eight times the amount sufficient to optimally sensitize said grains.

5. A photographic element comprising a transparent support and coated on at least one side thereof a light-sensitive silver halide emulsion layer, characterized in that said silver halide emulsion layer comprises low aspect ratio cubic silver halide grains and J-band spectral sensitizing dyes adsorbed on the surface of said cubic silver halide grains in an amount substantially higher than that amount which substantially optimally sensitizes said cubic grains.

6. The photographic element according to claim 5 wherein said support is a blue tinted transparent film support.

7. The photographic element according to claim 5 wherein said light sensitive silver halide emulsion layer comprises as a dispersing medium a hardenable hydrophilic colloid.

8. The photographic element according to claim 5 wherein said silver halide emulsion layer contains silver halide in an amount lower than 3 g/m$^2$ of silver.

9. The photographic element according to claim 5 wherein the silver halide in said silver halide emulsion layer is a silver bromo-iodide having an average grain size in the range from 0.2 to 1.5μ.

10. The photographic element according to claim 5 wherein said J-band spectral sensitizing dye is a carbocyanine dye.

11. The photographic element according to claim 5 wherein said J-band spectral sensitizing dye is represented by the following general formula:

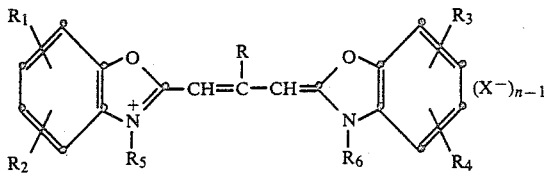

wherein R represents a hydrogen atom or an alkyl group; $R_1$, $R_2$, $R_3$ and $R_4$ each represent a hydrogen atom, a halogen atom, a hydroxy group, an alkoxy group, an amino group, an acylamino group, an acyloxy group, an alkoxycarbonyl group, an alkyl group, an alkoxycarbonylamino group or an aryl group; or, together, $R_1$ and $R_2$, and respectively $R_3$3 and $R_4$4, can be the atoms necessary to form a benzene nucleus; $R_5$ and $R_6$ each represent an alkyl group, a hydroxyalkyl group, an acetoxyalkyl group, an alkoxyalkyl group, a carboxyl group containing alkyl group, a sulfo group containing alkyl group, a benzyl group, a phenethyl group or a vinylmethyl group; $X^-$ represents an acid anion and n represents 1 or 2.

12. The photographic element according to claim 5 wherein said J-band spectral sensitizing dye is adsorbed on the surface of the cubic silver halide grains in an amount of two to eight times the amount sufficient to optimally sensitize said grains.

13. The photographic element according to claim 5 wherein said J-band spectral sensitizing dye is added to the cubic silver halide grains in reactive association with a water soluble iodide or bromide salt.

14. The photographic element according to claim 5 wherein said J-band spectral sensitizing dye is added to the cubic silver halide grains in reactive association with a supersensitizer.

15. The photographic element according to claim 5 wherein said J-band spectral sensitizing dye is added to the cubic silver halide grains in reactive association with a supersensitizing amount of a polymeric compound having an amino-allylidene-malononitrile moiety.

16. The photographic element according to claim 5 wherein said silver halide emulsion layer, comprising low aspect ratio cubic silver halide grains and J-band spectral sensitizing dyes adsorbed on the surface of said cubic grains in an amount substantially higher than that amout which substantially optimally sensitizes said cubic grains, is coated on both sides of the transparent support.

17. A light-sensitive silver halide emulsion comprising low aspect ratio cubic silver halide grains and J-band spectral sensitizing dyes adsorbed on the surface of said cubic silver halide grains in an amount substantially higher than that amount which substantially optimally sensitizes said cubic grains which amount is in the range of 0.5 to 2 millimoles of dye per mole of silver halide.

18. The light-sensitive silver halide emulsion according to claim 17 wherein the silver halide is a silver bromo-iodide having an average grain size in the range from 0.2 to 1.5μ.

19. The light-sensitive silver halide emulsion according to claim 17 wherein said J-band spectral sensitizing dye is a carbocyanine dye.

20. The light-sensitive silver halide emulsion according to claim 17 wherein said J-band spectral sensitizing dye is adsorbed on the surface of the cubic silver halide grains in an amount of two to eight times the amount sufficient to optimally sensitize said grains and from 0.6 to 1.2 millimoles of dye per mole of silver halide.

21. A photographic element comprising a transparent support having coated on at least one side thereof the emulsion of claim 17.

22. A photographic element comprising a transparent support having coated on at least one side thereof the emulsion of claim 18.

23. A photographic element comprising a transparent support having coated on at least one side thereof the emulsion of claim 19.

24. A photographic element comprising a transparent support having coated on at least one side thereof the emulsion of claim 20.

25. The photographic element according to claim 21 wherein said J-band spectral sensitizing dye is represented by the following general formula:

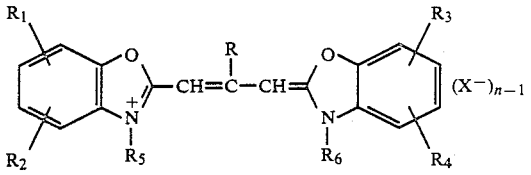

wherein R represents a hydrogen atom or an alkyl group; $R_1$, $R_2$, $R_3$ and $R_4$ each represent a hydrogen atom, a halogen atom, a hydroxy group, an alkoxy group, an amino group, an acylamino group, an acyloxy group, an alkoxycarbonyl group, an alkyl group, an alkoxycarbonylamino group or an aryl group; or, together, $R_1$ and $R_2$, and respectively $R_3$3 and $R_4$4, can be the atoms necessary to form a benzene nucleus; $R_5$ and $R_6$ each represent an alkyl group, a hydroxyalkyl group, an acetoxyalkyl group, an alkoxyalkyl group, a carboxyl group containing alkyl group, a sulfo group containing alkyl group, a benzyl group, a phenethyl group or a vinylmethyl group; X represents an acid anion and n represents 1 or 2.

26. The photographic element according to claim 21 wherein said J-band spectral sensitizing dye is added to the cubic silver halide grains in reactive association with a supersensitizer.

27. The photographic element according to claim 21 wherein said J-band spectral sensitizing dye is added to the cubic silver halide grains in reactive association with a supersensitizing amount of a polymeric compound having an amino-allylidene-malononitrile moiety.

* * * * *